US006979386B1

(12) United States Patent
Wallajapet et al.

(10) Patent No.: US 6,979,386 B1
(45) Date of Patent: Dec. 27, 2005

(54) TISSUE PRODUCTS HAVING INCREASED ABSORBENCY

(75) Inventors: Palani Raj R. Wallajapet, Neenah, WI (US); Dale A. Burghardt, Butte des Morts, WI (US); Sheng-Hsin Hu, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 406 days.

(21) Appl. No.: 09/643,979

(22) Filed: Aug. 22, 2000

Related U.S. Application Data

(60) Provisional application No. 60/150,325, filed on Aug. 23, 1999.

(51) Int. Cl.[7] ..... D21H 11/00

(52) U.S. Cl. ..... 162/109; 162/111; 162/112; 162/123; 162/125; 162/127; 162/141; 162/146; 162/158; 162/164.1; 162/164.3; 162/181.1; 428/378; 428/283; 428/290

(58) Field of Search ..... 162/109, 111, 112, 162/123, 125, 127, 141, 146, 158, 164.1, 162/164.3, 168.7, 181.1, 182, 183, 184; 428/378, 428/283, 290, 317.9, 315.7

(56) References Cited

U.S. PATENT DOCUMENTS

| | | | | |
|---|---|---|---|---|
| 2,666,369 | A | | 1/1954 | Niks |
| 3,485,706 | A | | 12/1969 | Evans |
| 3,556,932 | A | | 1/1971 | Coscia et al. |
| 3,556,933 | A | | 1/1971 | Williams et al. |
| 3,700,623 | A | | 10/1972 | Keim |
| 3,772,076 | A | | 11/1973 | Keim |
| 3,821,068 | A | | 6/1974 | Shaw |
| 3,826,711 | A | | 7/1974 | Schoggen et al. |
| 3,855,158 | A | | 12/1974 | Petrovich et al. |
| 3,899,388 | A | | 8/1975 | Petrovich et al. |
| 3,981,100 | A | | 9/1976 | Weaver et al. |
| 3,989,586 | A | | 11/1976 | Bashaw et al. |
| 3,997,484 | A | | 12/1976 | Weaver et al. |
| 4,128,692 | A | | 12/1978 | Reid |
| 4,129,528 | A | | 12/1978 | Petrovich et al. |
| 4,147,586 | A | | 4/1979 | Petrovich et al. |
| 4,187,342 | A | | 2/1980 | Holst et al. |
| 4,200,557 | A | | 4/1980 | Chatterjee et al. |
| 4,222,921 | A | | 9/1980 | Van Eenam |
| 4,232,674 | A | | 11/1980 | Melican |
| 4,260,443 | A | | 4/1981 | Lindsay et al. |
| 4,270,977 | A | | 6/1981 | Herman et al. |
| 4,295,987 | A | | 10/1981 | Parks |
| 4,354,901 | A | | 10/1982 | Kopolow |
| 4,372,312 | A | | 2/1983 | Fendler et al. |
| 4,414,255 | A | | 11/1983 | Tokuyama et al. |
| 4,500,585 | A | | 2/1985 | Erickson |
| 4,551,142 | A | | 11/1985 | Kopolow |
| 4,551,191 | A | | 11/1985 | Kock et al. |
| 4,675,394 | A | | 6/1987 | Solarek et al. |
| 4,770,657 | A | | 9/1988 | Ellis et al. |
| 4,851,069 | A | | 7/1989 | Packard et al. |
| 4,940,464 | A | | 7/1990 | Van Gompel et al. |
| 4,981,557 | A | | 1/1991 | Bjorkquist |
| 4,986,882 | A | * | 1/1991 | Mackey et al. ..... 162/109 |
| 5,008,344 | A | | 4/1991 | Bjorkquist |
| 5,048,589 | A | | 9/1991 | Cook et al. |
| 5,085,736 | A | | 2/1992 | Bjorkquist |
| 5,129,988 | A | | 7/1992 | Farrington, Jr. |
| 5,160,789 | A | | 11/1992 | Barcus et al. |
| 5,171,391 | A | | 12/1992 | Chmielewski et al. |
| 5,173,521 | A | | 12/1992 | Ishino |
| 5,175,046 | A | * | 12/1992 | Nguyen ..... 428/198 |
| 5,284,703 | A | | 2/1994 | Everhart et al. |
| 5,399,412 | A | | 3/1995 | Sudall et al. |
| 5,429,686 | A | | 7/1995 | Chiu et al. |
| 5,443,899 | A | | 8/1995 | Barcus et al. |
| 5,494,554 | A | | 2/1996 | Edwards et al. |
| 5,529,665 | A | | 6/1996 | Kaun |
| 5,558,873 | A | | 9/1996 | Funk et al. |
| 5,607,550 | A | | 3/1997 | Akers |
| 5,651,862 | A | | 7/1997 | Anderson et al. |
| 5,667,636 | A | | 9/1997 | Engel et al. |
| 5,779,860 | A | | 7/1998 | Hollenberg et al. |
| 5,795,439 | A | | 8/1998 | Euripides et al. |
| 5,814,188 | A | | 9/1998 | Vinson et al. |
| 5,830,317 | A | | 11/1998 | Vinson et al. |
| 5,837,627 | A | | 11/1998 | Halabisky et al. |
| 5,883,231 | A | | 3/1999 | Achter et al. |
| 5,902,297 | A | | 5/1999 | Sauer |
| 5,904,672 | A | | 5/1999 | LeMahieu et al. |
| 5,904,675 | A | | 5/1999 | Laux et al. |

(Continued)

FOREIGN PATENT DOCUMENTS

| | | | |
|---|---|---|---|
| EP | 359615 | A1 | 3/1990 |

(Continued)

OTHER PUBLICATIONS

Merriam-Wbster's Collegiate Dictionary, 1993, p. 847.*

(Continued)

*Primary Examiner*—Mark Halpern
(74) *Attorney, Agent, or Firm*—Dority & Manning, P.A.

(57) ABSTRACT

A tissue product containing a cellulosic fibrous material and less than about 10 wt. % of a superabsorbent material (e.g., fibers, particles, etc.) is provided. In some instances, the superabsorbent material can absorb between about 100 to about 350 grams of an aqueous solution per gram of superabsorbent material. In some embodiments, the superabsorbent material can be applied at the stock-preparation stage of a papermaking process, and can be provided in a dry or preswollen state.

24 Claims, 1 Drawing Sheet

U.S. PATENT DOCUMENTS

| | | | | |
|---|---|---|---|---|
| 5,919,178 | A | 7/1999 | Widlund | |
| 5,964,973 | A | 10/1999 | Heath et al. | |
| 5,997,690 | A | 12/1999 | Woodrum | |
| 6,022,818 | A | 2/2000 | Welchel et al. | |
| 6,136,873 | A | 10/2000 | Hahnle et al. | |
| 6,416,624 | B1 * | 7/2002 | Nielsen et al. | 162/155 |

FOREIGN PATENT DOCUMENTS

| | | | |
|---|---|---|---|
| EP | 339461 | B1 | 1/1993 |
| EP | 540041 | B1 | 5/1993 |
| EP | 437816 | B1 | 7/1995 |
| WO | WO 8606623 | | 11/1986 |
| WO | WO 9404751 | | 3/1994 |
| WO | WO 9717397 | | 5/1997 |
| WO | WO 9736047 | | 10/1997 |
| WO | WO 9824392 | | 6/1998 |
| WO | WO 9824621 | | 6/1998 |
| WO | WO 9851251 | | 11/1998 |
| WO | WO 9934057 | | 7/1999 |

OTHER PUBLICATIONS

TAPPI Provisional Method T 543 pm-84, "Stiffness of Paper (Gurley Type Stiffness Tester)," published by the TAPPI Press, Atlanta, Georgia, pp. 1-3.

Derwent World Patent Database abstract of Japan Carlit Co. Ltd. (JCAR): Description of JP 03-185197, "Tissue Paper Having High Tensile Strength and Water Dispersibility."

PCT Search Report; Application No. PCT/US00/22978; Dec. 28, 2000.

* cited by examiner

TISSUE PRODUCTS HAVING INCREASED ABSORBENCY

RELATED APPLICATIONS

The present application is based upon a provisional application filed on Aug. 23, 1999 having Ser. No. 60/150,325.

BACKGROUND OF THE INVENTION

Tissue products, such as facial tissues, paper towels, bath tissues and other similar products, are designed to include several important properties. For example, the products should have good bulk, a soft feel and should have good integrity. Moreover, it is often desirable to provide such tissues with high absorbency characteristics, particularly when used in certain applications, such as paper towels.

In the past, superabsorbent materials have been applied to paper products to increase their absorbency characteristics. For example, superabsorbents have been applied to dry sheets. Moreover, superabsorbents have also been applied to wet base sheets. For example, EP 0 359 615 A1 describes one method of applying a superabsorbent material to a wet base sheet. However, one problem associated with applying superabsorbent material to a dry sheet or to a wet base sheet in a conventional manner is that the superabsorbent material is not uniformly distributed throughout the paper web. As a result, only portions of the paper web may have sufficient absorbent capabilities.

As such, a need currently exists for an improved method of uniformly incorporating a superabsorbent material into a tissue product.

SUMMARY OF THE INVENTION

The present invention is generally directed to a method for forming tissue products having improved absorbency properties. In particular, a tissue product formed in accordance with the present invention is typically formed from a cellulosic fibrous material and a superabsorbent material in an amount of less than about 10% by weight of the tissue product.

The tissue product of the present invention can generally be produced from a paper web having one or multiple layers. Moreover, depending on the desired characteristics of the tissue, the tissue product can be a single-ply tissue or a multi-ply tissue. Normally, the basis weight of the tissue product is less than about 100 grams per square meter (gsm), particularly less than about 70 gsm, and more particularly from about 10 to about 40 gsm. In addition, any of a variety of materials can be used to form the tissue product. For example, the material used to make a tissue product of the present invention can include pulp fibers either alone or in combination with other types of fibers, such as synthetic fibers.

Moreover, as stated above, a superabsorbent material ("SAM") is also included within the tissue product of the present invention. A superabsorbent material can provide excellent absorption capabilities to the tissue product. In general, a superabsorbent material of the present invention can absorb at least about 10 times its weight, and in some embodiments at least about 30 times its weight, of an aqueous solution, such as water. Moreover, a superabsorbent material of the present invention can generally absorb at least about 20 grams of an aqueous solution per gram of the SAM, particularly at least about 50 grams, and more particularly between about 100 grams to about 350 grams of an aqueous solution per gram of SAM.

In general, the amount of superabsorbent material utilized can vary. In most embodiments, the superabsorbent material can be applied in an amount less than about 10% by weight of the tissue. In particular, superabsorbent material concentrations between about 0.1% by weight to about 10% by weight, particularly between about 0.1% by weight to about 5% by weight, and more particularly, between about 0.1% to about 3% by weight, can be utilized.

A variety of superabsorbent materials can also be utilized within a tissue product formed in accordance with the present invention. For instance, in one embodiment, fibrous superabsorbent materials, such as OASIS 101 (available from Technical Absorbents Ltd., United Kingdom) can be utilized. In another embodiment, particulate superabsorbent materials, such as FAVOR 880 (available from Stockhausen) can be utilized.

When incorporated into a tissue product of the present invention, the superabsorbent material can be combined with the papermaking fibers at any stage of during formation of a web. For example, in some embodiments, the superabsorbent material can be combined with the fibers at the "stock-preparation stage" of a papermaking process. As used herein, the phrase "stock-preparation stage" generally refers to any stage or step of a papermaking process that occurs prior to forming a web, such as, but not limited to, the pulper, machine chest, headbox, and the like. The superabsorbent material may be applied at one or more steps during the stock-preparation stage.

In general, the superabsorbent material can be applied in either a "dry state" or "pre-swollen state". A dry state superabsorbent material may become swollen upon being mixed with a liquid suspension of fibrous material. This swelling of the superabsorbent material can have a variety of beneficial effects on web formation. For example, cellulosic fibers typically dry faster than swollen superabsorbent materials. Thus, during the web-drying step, the swollen, partially wet superabsorbent material can allow the structure of the fibrous web to remain open, thereby resulting in a tissue product having higher bulk, permeability, and void volume. Dry superabsorbent materials may be particularly useful when applied at certain steps, such as at the pulper or machine chest.

Moreover, as stated, the superabsorbent material may also be "pre-swollen" before being incorporated into the tissue product. The amount of pre-swelling can vary, depending on factors such as the nature of the solution and the time in which the superabsorbent material is allowed to remain therein. For instance, in some embodiments, the superabsorbent material can be preswollen in an amount of at least about 30% of its total swelling capacity, in some embodiments at least about 50%, in some embodiments at least about 70%, and in some embodiments, at least about 90% of its swelling capacity. Pre-swelling may be particularly useful when applying the superabsorbent material at certain steps, such as the headbox.

Besides the materials mentioned above, other various additives or materials can also be used in forming a tissue product of the present invention. For example, various softening agents, wet-strength agents, binders, etc., can be applied. In fact, by utilizing a superabsorbent material in conjunction with a wet-strength agent, it has been discovered that the strength of the tissue product can be further increased. In particularly, a swollen superabsorbent material can reduce the number of fiber- crossover points as indicated above. As a result of the reduced number of cross-over points, the wet-strength agent can have a greater effect on a smaller number of points, thereby resulting in a paper web that is strong, yet soft.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figure in which.

Figure 1:
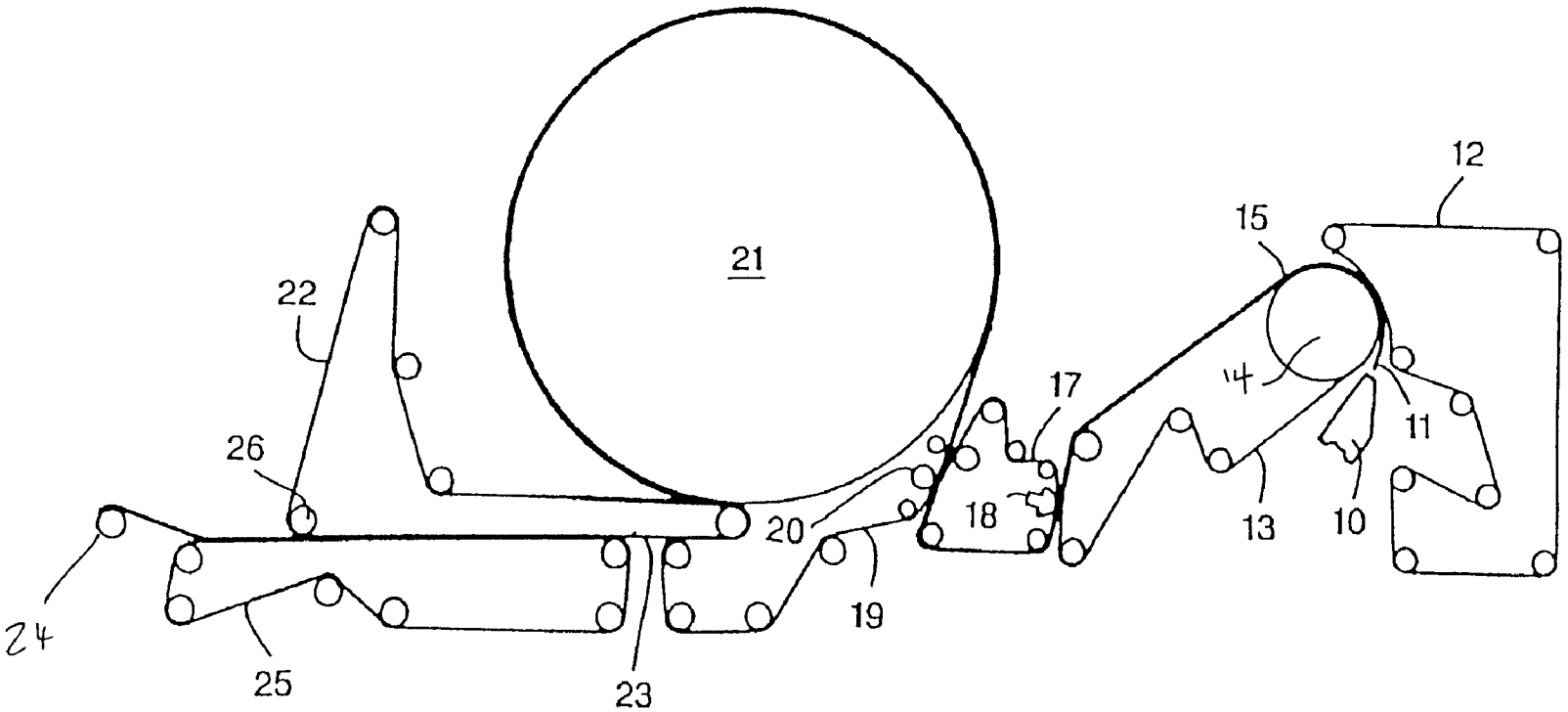
FIG. 1 is illustrates one embodiment of the present invention for forming a tissue product with a superabsorbent material.

Repeat use of reference characters in the present specification and drawings is intended to represent same or analogous features or elements of the present invention.

DETAILED DESCRIPTION OF REPRESENTATIVE EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to tissues having enhanced absorption capabilities. In particular, it has been discovered that a superabsorbent material can be incorporated into a tissue product such that the resulting product is strong, soft, and has excellent absorption capabilities. As used herein, a "tissue product" generally refers to various paper products, such as facial tissue, bath tissue, paper towels, and the like. A tissue product of the present invention can generally be produced from a paper web having one or multiple layers. Moreover, depending on the desired characteristics of the tissue, the tissue product can be a single- or multi-ply tissue. In one embodiment, for example, a three-ply tissue can contain two plies containing a superabsorbent material of the present invention. Normally, the basis weight of a tissue of the present invention is less than about 100 grams per square meter (gsm), particularly less than about 70 grams per square meter, and more particularly between about 10 to about 40 gsm.

Regardless of the overall structure of the tissue product, any of a variety of materials can be used to form the tissue product. For example, the material used to make a tissue product of the present invention can include pulp fibers either alone or in combination with other types of fibers. The pulp fibers may be softwood fibers having an average fiber length of greater than 1 mm and particularly from about 2 to 5 mm based on a length-weighted average. Such fibers can include northern softwood kraft, southern softwood kraft, redwood, red cedar, hemlock, pine (e.g. southern pines), spruce (e.g. black spruce), combinations thereof, and the like. Exemplary commercially available pulp fibers suitable for the present invention include those available from Kimberly-Clark Corporation under the trade designations "Longlac-19". Hardwood fibers, such as eucalyptus, maple, birch, aspen, and the like, can also be used. Moreover, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and the like. In addition, synthetic fibers can also be utilized, so long as such fibers do not have a substantial affect on the absorbency of the resulting tissue product. Some suitable synthetic fibers can include, but are not limited to, rayon fibers, ethylene vinyl alcohol copolymer fibers, polyolefin fibers, polyesters, and the like.

In some embodiments, the fibers can also be curled or crimped. As is known in the art, the fibers can be curled or crimped, for instance, by adding a chemical agent to the fibers or subjecting the fibers to a mechanical process. Curled or crimped fibers may create more entanglement and void volume within the web and further increase the amount of fibers oriented in the −z direction as well as increase web strength properties.

In accordance with the present invention, a "superabsorbent material" is also generally incorporated into a tissue product of the present invention. By utilizing a "superabsorbent" material, the tissue product can be provided with a number of benefits, including excellent absorption capabilities. As used herein, the term "superabsorbent material" ("SAM") refers to any substantially water-swellable, water-insoluble material capable of absorbing, swelling, or gelling, at least about 10 times its weight, and in some embodiments at least about 30 times its weight, in an aqueous solution, such as water. Moreover, a superabsorbent material of the present invention can generally absorb at least about 20 grams of an aqueous solution per gram of the SAM, particularly at least about 50 grams, more specifically at least about 75 grams, and more particularly between about 100 grams to about 350 grams of aqueous solution per gram of SAM. In contrast, pulp fibers, for example, can typically only absorb about 6 grams of water per gram of pulp.

In general, the amount of superabsorbent material utilized can vary depending on the desired characteristics of the resulting tissue product. In most embodiments, the superabsorbent material can be applied in amounts less than about 10% by weight of the tissue. In some embodiments, superabsorbent material concentrations between about 0.1% by weight to about 10% by weight, particularly between about 0.1% by weight to about 5% by weight, and more particularly, between about 0.1% to about 3% by weight, can be utilized. In fact, it has been discovered that even minute amounts of a superabsorbent material can significantly improve the absorbent capacity of the tissue product when utilized in accordance with the present invention. For example, a superabsorbent material present in an amount of only about 1% by weight can increase the absorbent capacity of the tissue by about 15%.

Some suitable superabsorbent materials that can be used in the present invention include inorganic and organic materials. For example, some suitable inorganic superabsorbent materials can include absorbent clays and silica gels. Moreover, some suitable superabsorbent organic materials include natural materials, such as agar, pectin, guar gum, etc., as well as synthetic materials, such as synthetic hydrogel polymers.

Such hydrogel polymers include, for example, alkali metal salts of polyacrylic acids, polyacrylamides, polyvinyl alcohol, ethylene maleic anhydride copolymers, polyvinyl ethers, methyl cellulose, carboxymethyl cellulose, hydroxypropylcellulose, polyvinylmorpholinone; and polymers and copolymers of vinyl sulfonic acid, polyacrylates, polyacrylamides, polyvinylpyrridine, and the like. Other suitable polymers include hydrolyzed acrylonitrile grafted starch, acrylic acid grafted starch, and isobutylene maleic anhydride polymers and mixtures thereof. The hydrogel polymers can be lightly cross-linked to render the materials substantially water-insoluble. Cross-linking may, for example, be accomplished by irradiation or by covalent, ionic, van der Waals, or hydrogen bonding.

The superabsorbent materials of the present invention may be provided in any form suitable for use in absorbent composites including particles, fibers, flakes, filaments, spheres, and the like. For example, one suitable fibrous superabsorbent material is available from Technical Absorbents Ltd., United Kingdom, under the tradename OASIS 101. Moreover, one example of a suitable particulate superabsorbent material is FAVOR 880 available from Stockhausen, Inc., located in Greensboro, N.C. Although not required, particulate superabsorbent materials generally have particle sizes ranging from about 20 to about 2000 microns.

A tissue product containing a superabsorbent material in accordance with the present invention can generally be formed by any of a variety of papermaking processes known in the art. In particular, it should be understood that the present invention is not limited to any particular papermaking process. In fact, any process capable of forming a paper web can be utilized in the present invention. For example, a papermaking process of the present invention can utilize adhesive creping, wet creping, double creping, embossing, wet-pressing, air pressing, through-air drying, creped through-air drying, uncreped through-drying, as well as other steps in forming the paper web. Some examples of such techniques are disclosed in U.S. Pat. No. 5,048,589 to Cook, et al.; U.S. Pat. No. 5,399,412 to Sudall, et al.; U.S. Pat. No. 5,129,988 to Farrington, Jr.; U.S. Pat. No. 5,494,554 to Edwards, et al.; which are incorporated herein in their entirety by reference thereto.

In this regard, referring to FIG. 1, one embodiment of a papermaking process that can be used in the present invention is illustrated. For simplicity, the various tensioning rolls schematically used to define the several fabric runs are shown but not numbered. Initially, a fibrous material is placed in a conventional paper making fiber stock prep beater or pulper (not shown) containing a liquid, such as water. If the fibers are cellulosic in nature, for example, the fibers may be refined in the beater or pulper until they become hydrated with the water. The fibrous material stock is typically kept in continued agitation such that it forms a liquid suspension can be formed.

In some embodiments, a superabsorbent material may be combined with the fibers either after or as the liquid suspension is formed within the pulper. After being intermixed, optionally with a superabsorbent material, the fibrous suspension can then be diluted and readied for formation into a layer of fibrous web using conventional papermaking techniques. In this regard, the fibrous suspension (i.e., stock slurry) may be stored in any apparatus, such as in a machine chest (not shown), prior to forming the web. In some embodiments, the superabsorbent material can also be combined with the fibrous material at the machine chest, prior to forming the web. If desired, the pH of the stock slurry can also be adjusted for equipment compatibility.

As shown, a papermaking headbox 10 can then be used to inject or deposit a stream 11 of an aqueous suspension of papermaking fibers onto the forming fabric 12. The headbox 10 may be any tissue-forming headbox used in the art, such as a stratified headbox capable of producing a multilayered web. For example, it may be desirable to provide relatively short or straight fibers in one layer of the basesheet to give a layer with high capillary pressure, while the other layer comprises relatively longer, bulkier, or more curled fibers for high permeability and high absorbent capacity and high pore volume. It may also be desirable to apply different chemical agents to separate layers of a single web to optimize dry and wet strength, pore space, wetting angle, appearance, or other properties of a web. Further, multiple headboxes may be used to create a layered structure, as is known in the art.

In some embodiments, the superabsorbent material can be added to the fibrous material at the headbox. For example, the superabsorbent material can be injected into the liquid suspension stream 11 just prior to entering the headbox 10. Moreover, when incorporated into a paper web having multiple layers, the superabsorbent material can generally be incorporated into any of the layers, either alone or in combination with cellulosic fibers. For example, in one embodiment, one of the layers can contain a mixture of a superabsorbent material and a cellulosic fibrous material. In another embodiment, a multi-layered paper web can also be provided that includes one layer of a superabsorbent material contained between layers of cellulosic fibers that act to substantially prevent the superabsorbent material from migrating from the web. It should be understood, however, that a multilayered paper web, such as described above, can be formed without using stratified or multiple headboxes, and can generally be formed according to any process known in the art.

In some embodiments, the superabsorbent material can be applied in either a "dry state" or a "pre-swollen state". For instance, pre-swelling may be especially desired when applying the superabsorbent material to certain stages of the papermaking process, such as to the headbox. In particular, at least some pre-swelling can ensure that the superabsorbent material has sufficient time to adequately swell during the process.

The extent of pre-swelling can range from only a small amount of swelling to full swelling. To accomplish the desired amount of pre-swelling, the superabsorbent material can be placed in an aqueous solution, such as water, for a certain period of time. The amount of pre-swelling can vary, depending on a variety of factors, such as the time in which the superabsorbent material is allowed to remain in the solution, the type of superabsorbent material, the amount of superabsorbent material, the stage of the process in which the material is applied, the desired amount of tissue absorbency, and the like. For instance, in some embodiments, the superabsorbent material can be preswollen at least about 30% of its total swelling capacity, in some embodiments at least about 50%, in some embodiments at least about 70%, and in some embodiments, at least about 90% of its total swelling capacity. Moreover, in some instances, the nature of the aqueous solution in which the superabsorbent material is dissolved can also be varied. For example, water can be provided with differing amounts of dissolved solids to control the amount of swelling of the superabsorbent material therein.

As stated, the superabsorbent material can also be applied in a dry state. Applying the superabsorbent material in a dry state can be particularly useful at certain steps of the papermaking process. For instance, in some embodiments, a dry state superabsorbent material can be combined with the fibrous suspension in the pulper or machine chest to ensure that the dry state superabsorbent material has a sufficient time to swell. A dry state superabsorbent material can, in some circumstances, become swollen upon being mixed with a liquid suspension of fibrous material. This swelling of the superabsorbent material can have a variety of beneficial affects effects on web formation. For example, cellulosic fibers typically dry faster than swollen superabsorbent materials. Thus, during the web-drying step (described below), the swollen, partially wet superabsorbent material can allow the structure of the fibrous web to remain open, thereby resulting in a tissue product having higher bulk, permeability, and void volume.

From the stock-preparation stage, the fibrous slurry can then be transferred to the web-forming stage. For example, in one embodiment, with the aid of a roll 14, the fibrous stream 11 can then be transferred to a fabric 13, which serves to support and carry the newly-formed wet web 15 downstream in the process as the web 15 is partially dewatered to a consistency of about 10 dry weight percent. Additional dewatering of the wet web can be carried out, such as by vacuum suction, while the wet web is supported by the forming fabric.

The wet web 15 is then transferred from the fabric 13 to a transfer fabric 17, which typically travels at a slower speed than the fabric 13 in order to impart increased stretch into the web. This is commonly referred to as "rush" transfer. One useful method of performing rush transfer is taught in U.S. Pat. No. 5,667,636 to Engel et al., which is incorporated herein in its entirety by reference thereto. The relative speed difference between the two fabrics can be from 0% to about 80%, particularly greater than about 10%, more particularly from about 10% to about 60%, and most particularly from about 10% to about 40%. Transfer may be carried out with the assistance of a vacuum shoe 18 such that the forming fabric and the transfer fabric simultaneously converge and diverge at the leading edge of the vacuum slot.

Thereafter, any of a variety of papermaking techniques, such as drying, creping, embossing, etc., can be utilized. For example, the fibrous web 15 can be dried. Drying processes that incorporate infra-red radiation, Yankee dryers, through-air dryers, vacuum dewatering, microwaves, ultrasonic energy, etc., can be used. Thermal post-treatments can be further be used, alone or in combination with drying, to fuse a portion of any thermally fusable fibers that may be present in the material.

For example, as shown in FIG. 1, in one embodiment, the web 15 is transferred from the transfer fabric 17 to a through-drying fabric 19 with the aid of a vacuum transfer roll or shoe 20. The through-drying fabric 19 can be traveling at about the same speed or a different speed relative to the transfer fabric 17. For example, if desired, the through-drying fabric 19 can run at a slower speed to further enhance stretch. The vacuum transfer roll or shoe 20 (negative pressure) can be supplemented or replaced by the use of positive pressure from the opposite side of the web to blow the web onto the next fabric.

The through-dryer 21 can accomplish the removal of moisture from the web 15 by passing air through the web without applying any mechanical pressure, i.e., non-compressive drying. Non-compressive drying can also increase the bulk and softness of the web. In one embodiment, for example, the through-dryer can contain a rotatable, perforated cylinder and a hood (not shown) for receiving hot air blown through perforations of the cylinder as through-drying fabric 19 carries the fibrous web 15 over the upper portion of the cylinder. The heated air is forced through the perforations in the cylinder of the through-dryer 21 and removes the remaining water from the fibrous web 15. The temperature of the air forced through the fibrous web 15 by the through-dryer 21 can vary, but is typically from about 300° F. to about 600° F.

When the web 15 contains a superabsorbent material, the drying step can provide additional benefits to the resulting tissue product. In particular, during the drying step, the cellulosic fibers normally dry at a faster rate than the superabsorbent materials. Thus, the cellulosic fibers may be completely dried while the superabsorbent material may possess some remaining moisture content. For instance, in some embodiments, the superabsorbent material is dried to have a moisture content of less than about 50% of the weight of the SAM, and particularly less than about 25%. Moreover, the moisture content of the overall web after drying can be between about 5% to about 20%, in some embodiments between about 5% to about 15% by weight of the web, and in some embodiments, between about 5% to about 10% by weight of the web.

The remaining moisture content can provide a number of benefits. For example, because it is not generally necessary to completely dry the superabsorbent material, the process can become more efficient by utilizing less energy to dry the web. Further, the tissue product can have a higher basis weight due to the added moisture content. In addition, the remaining moisture content can act as a "liquid reservoir" to increase the equilibrium moisture content of the final tissue product.

Although this additional moisture content is generally beneficial to the web-forming process, it can, in some instances, promote the growth of certain undesired microbials, particularly when the moisture content becomes significantly greater than about 20% by weight of the web. Nevertheless, to further ensure against such microbial growth, various known anti-microbial agents can be applied to the paper web. Moreover, in some embodiments, the superabsorbent material itself can be modified so that it possesses the desired anti-microbial characteristics.

In addition to the above benefits, drying the paper web can also provide various other benefits in accordance with the present invention. In particular, the superabsorbent material can also become firmly attached to the cellulosic fibers as the web is dried. It is believed that this attachment may be due to the hydrogen bonds and ester links formed between the carboxyl functionalities of the superabsorbent material and the hydroxyl groups of the cellulosic fibers, as well as the actual physical entrapment of the superabsorbent material within the fibrous matrix. Because the superabsorbent material can become firmly attached to the cellulosic fibers, its separation from the web upon wetting may be minimized.

The dried web 23 can then be transported by a carrier fabric 22 to a reel 24, where it can be wound. An optional turning roll 26 or fabric 25 can be used to facilitate transfer of the web from the carrier fabric 22 to the reel 24. Although not shown, reel calendering or subsequent off-line calendering can be used to improve the smoothness and softness of the basesheet. Besides calendering, any of a variety of other finishing steps can also be utilized. For example, the web may be brushed to provide a uniform exterior appearance and/or certain tactile properties. The material can also be wet creped, dry creped, and/or mechanically softened via other methods to improve softness and hand. Such processes can be in-line prior to winding up the fabric onto a roll, or they can be off-line. Adhesive recreping can be further used to improve strength and bulk properties. In addition, printed finishes can be applied to improve aesthetics.

In some embodiments, the superabsorbent material can also be applied during the web-forming stage. The web-forming stage generally refers to steps of a papermaking process that occur after the fibers are deposited on the forming fabric or wire, and before the web is dried. For example, in one embodiment, the superabsorbent material may be applied to the wet web 15 as it is formed onto the forming fabric 12 or the fabric 13. For instance, in one embodiment, the superabsorbent material can be sprayed onto the wet web 15 utilizing any of a variety of known spraying techniques. In other embodiments, the superabsorbent material may additionally be applied at the converting stage. The converting stage generally refers to any stage of the papermaking process that occurs after drying the web. When applied at these stages, it may be desired that the superabsorbent material be added in a pre-swollen or dried state. Once applied to a dry web, the web can then be contacted with an aqueous solution, such as water, to initiate swelling. For instance, in one embodiment, the superabsorbent material can be exposed to high humidity utilizing, for example, a steam shower. In other instances, however, the superabsorbent material can be maintained in its dry or pre-swollen state. In such instances, the superabsorbent material can become fully swollen upon wetting of the tissue product by a consumer, thereby effecting the desired increase in absorbency capability of the tissue. Further, in one embodiment, the superabsorbent material can be metered onto the dried paper web 23 before winding onto a roll 24. In some embodiments, the superabsorbent material can also be metered in between two or more plies of the web 23.

Besides superabsorbent materials, additional chemical treatments can also be utilized at any stage of the papermaking process. For example, application of liquid treatments such as dyes, wet-strength agents, binders, brighteners, flame retardants, germicides, softening agents, starches, corrosion inhibitors, textile finishes, citric acid, ethylene diamine, etc., can be accomplished using spraying, dipping, squeeze techniques, vacuum extraction, liquid curtains, saturation techniques, and the like.

For example, in order to strengthen the tissue, various wet-strength agents can be applied in accordance with the present invention. Particular wet-strength agents that may be used in the present invention include latex compositions, such as acrylates, vinyl acetates, vinyl chlorides, and methacrylates. Some water-soluble wet-strength agents may also be used including polyacrylamides (e.g., glyoxylated polyacrylamides), polyvinyl alcohols, and carboxymethyl cellulose. In one embodiment, the wet-strength agent used in the present invention contains an ethylene vinyl acetate copolymer. In particular, the ethylene vinyl acetate copolymer can be cross-linked with n-methyl acrylamide groups using an acid catalyst. Suitable acid catalysts include ammonium chloride, citric acid, and maleic acid.

When utilized, a wet-strength agent can increase the strength of a web by fortifying the bonds of the cellulosic fibers at points in which they cross each other. Moreover, by utilizing a superabsorbent material in conjunction with a wet-strength agent, it has been discovered that the strength of the tissue product can be further increased. In particular, swollen superabsorbent material can reduce the number of fiber-crossover points. As a result of the reduced number of crossover points, the wet-strength agent can have a greater affect on a small number of points, thereby resulting in a paper web that is strong, yet soft. In addition, as stated, a tissue product of the present invention can also include a chemical debonding or softening agent to further enhance the "soft feel" to the tissue product. Some softening agents are also believed to act as lubricants or friction reducers. Any material that has some affinity to fibers and is capable of reducing fiber bonding and/or reducing friction, can generally be used as a softening agent. Some examples of suitable softening agents can include, but are not limited to, quaternary ammonium compounds, imidazolinium compounds, bis-imidazolinium compounds, phospholipid deriviatives, polydimethylsiloxanes and related cationic and non-ionic silicone compounds, fatty & carboxylic derivatives, mono- and polysaccharide derivatives, polyhydroxy hydrocarbons, etc. Still other suitable softening agents are disclosed in U.S. Pat. No. 5,529,665 to Kaun and U.S. Pat. No. 5,558,873 to Funk, et al., which are incorporated herein in their entirety by reference thereto. For example, Kaun discloses the use of various silicone compositions as softening agents.

In alternative embodiments, the softening agent can also contain anti-microbial agents for destroying germs that come in contact with the paper web. For instance, one commercially available softening having anti-microbial properties is DOW 5700 marketed by the Dow-Corning Corporation of Midland, Mich. DOW 5700 is a silicone quaternary spray that contains anti-microbial agents. In other embodiments, the softening agent can also include a fragrance or odor maskant.

Besides the above-mentioned materials, it should be understood that any other additive, agent, or material can be added to a tissue product of the present invention, if desired. For example, additional additives and/or softening agents are described in U.S. Pat. No. 5,814,188 to Vinson, et al. and U.S. Pat. No. 5,830,317 to Vinson et al., which are incorporated herein in their entirety by reference thereto.

In some embodiments, to further ensure that the superabsorbent material is contained within the tissue product, a variety of containment mechanisms can be utilized. For example, one or more of the layers can be separated by a tissue wrapsheet, a high density fiber layer, or other similar layer to prevent substantial dry migration of the superabsorbent material between the two layers. Moreover, in one embodiment, the cellulosic fibers can be crimped so that the superabsorbent material can be trapped within the crimps of the paper web. In another embodiment, a multi-ply tissue product can be lightly pressed between calender rolls to further ensure that a superabsorbent material contained within the plies is sufficiently contained therein.

In addition, various additives, such as binders, can also be utilized to further ensure that the superabsorbent material is contained within the tissue product. Binders can help the superabsorbent material adhere to the fibrous material, particularly when the fibers and material form a mixture. For example, in one embodiment, polymeric binder fibers can be added to the liquid suspension at the stock-preparation stage or any other stage of the papermaking process. Some suitable binder fibers that can be used in the present invention are adhesives. Examples of adhesives that can be used in the present invention include, but are not limited to, acrylates, styrene butadiene, vinyl chlorides, methacrylates, acrylics (such as carboxylated acrylics), and vinyl acetates (such as self cross-linking ethyl vinyl acetate, hydrolyzed polyvinyl acetate, or non cross-linking ethyl vinyl acetate). In certain embodiments, the adhesive can be a carboxylated acrylic, such as a HYCAR-brand acrylic carboxylated latex.

For example, in one embodiment, the binders can be printed onto a web that is then double re-creped.

The present invention may be better understood with reference to the following examples:

EXAMPLE 1

The ability to form a tissue with a superabsorbent material was demonstrated. Initially, a liquid suspension of pulp fibers ("Longlac-19") was dispersed using a British Disintegrator to form a liquid suspension.

Thereafter, a dry, superabsorbent material (Oasis 101 from Technical Absorbents) was then added to the suspension such that the resulting fiber furnish contained 95% pulp fibers and 5% superabsorbent material.

After forming the furnish, a paper web having a basis weight of 14 grams per square meter was formed using a TAPPI handsheet mold and conventional web-forming techniques, such as described above. Once the web was formed, it was then placed onto a stainless steel screen and dried in a convection oven at 105° C. After drying, the formed web was then removed from the dryer and examined. It was subjectively determined that the superabsorbent material was retained within the dried web.

EXAMPLE 2

The ability to form a tissue with a superabsorbent material was demonstrated. Initially, pulp fibers ("Longlac-19") and superabsorbent material (Oasis 101 from Technical Absorbents) were mixed and dispersed using a British Disintegrator to form a liquid suspension containing 95% pulp fibers and 5% superabsorbent material.

After forming the furnish, a paper web having a basis weight of 14 grams per square meter was formed using a TAPPI handsheet mold and conventional web-forming techniques, such as described above. Once the web was formed, it was then placed onto a stainless steel screen and dried in a convection oven at 105° C. After drying, the formed web was then removed from the dryer and examined. It was subjectively determined that the superabsorbent material was retained within the dried web.

EXAMPLE 3

The ability to form a tissue with a superabsorbent material was demonstrated. Initially, a liquid suspension of pulp fibers ("Longlac-19") was dispersed using a British Disintegrator to form a liquid suspension. Thereafter, a dry, superabsorbent material (Oasis 101 from Technical Absorbents) was then applied to the suspension such that the resulting fiber furnish contained 95% pulp fibers and 5% superabsorbent material.

After forming the furnish, a paper web having a basis weight of 40 grams per square meter was formed using a TAPPI handsheet mold and conventional web-forming techniques, such as described above. Once the web was formed, it was then placed onto a stainless steel screen and dried in a convection oven at 105° C. After drying, the formed web was then removed from the dryer and examined. It was subjectively determined that the superabsorbent material was retained within the dried web.

EXAMPLE 4

The ability to form a tissue with a superabsorbent material was demonstrated. Initially, pulp fibers ("Longlac-19") and superabsorbent material (Favor 880 from Stockhausen) were mixed and dispersed using a British Disintegrator to form a liquid suspension containing 95% pulp fibers and 5% superabsorbent material.

After forming the furnish, a paper web having a basis weight of 40 grams per square meter was formed using a TAPPI handsheet mold and conventional web-forming techniques, such as described above. Once the web was formed, it was then placed onto a stainless steel screen and dried in a convection oven at 105° C. After drying, the formed web was then removed from the dryer and examined. It was subjectively determined that the superabsorbent material was retained in the dried web.

Although various embodiments of the invention have been described using specific terms, devices, and methods, such description is for illustrative purposes only. The words used are words of description rather than of limitation. It is to be understood that changes and variations may be made by those of ordinary skill in the art without departing from the spirit or scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

What is claimed is:

1. A method for forming a tissue product, said method comprising:

forming a paper web from a cellulosic fibrous material and a pre-swollen superabsorbent material, wherein said superabsorbent material comprises from about 0.1% to 3% by weight of said paper web, said superabsorbent material having a total swelling capacity of at least about 20 grams of an aqueous solution per gram of said superabsorbent material; and at least partially drying said paper web;

wherein the tissue product is formed primarily from said paper web, the tissue product having a basis weight less than about 100 grams per square meter.

2. A method for forming a tissue product as defined in claim 1, wherein said tissue product is formed primarily from said paper web and one or more additional paper webs.

3. A method for forming a tissue product as defined in claim 1, wherein said superabsorbent material is pre-swollen to at least about 30% of its total swelling capacity.

4. A method for forming a tissue product as defined in claim 1, wherein said superabsorbent material is pre-swollen to at least about 50% of its total swelling capacity.

5. A method for forming a tissue product as defined in claim 1, wherein said superabsorbent material has a total swelling capacity of at least about 50 grams of an aqueous solution per gram of said superabsorbent material.

6. A method for forming a tissue product as defined in claim 1, wherein said superabsorbent material has a total swelling capacity of from about 100 to about 350 grams of an aqueous solution per gram of said superabsorbent material.

7. A method for forming a tissue product as defined in claim 1, further comprising applying a wet-strength agent, a softening agent, or combinations thereof, to said paper web.

8. A method for forming a tissue product as defined in claim 1, wherein said paper web is dried to a moisture content of less than about 20% by weight of said web.

9. A method for forming a tissue product as defined in claim 1, wherein said paper web is dried to a moisture content of from about 5% to about 15% by weight of said web.

10. A method for forming a tissue product as defined in claim 1, wherein said cellulosic fibrous material and said superabsorbent material are combined before or during the formation of said paper web.

11. A method for forming a tissue product as defined in claim 1, wherein said cellulosic fibrous material and said superabsorbent material are combined in a headbox.

12. A method for forming a tissue product as defined in claim 1, wherein said superabsorbent material includes clay, silica gel, agar, pectin, guar gum, a hydrogel polymer, or combinations thereof.

13. A method for forming a tissue product as defined in claim 1, wherein said superabsorbent material includes particles, fibers, flakes, filaments, spheres, or combinations thereof.

14. A method for forming a tissue product as defined in claim 1, wherein said superabsorbent material is a fibrous material.

15. A method for forming a tissue product as defined in claim 1, wherein said paper web is dried using a through-air dryer.

16. A method for forming a tissue product as defined in claim 1, wherein said superabsorbent material is dried to a moisture content of less than about 50% of the weight of said superabsorbent material.

17. A method for forming a tissue product as defined in claim 1, wherein said superabsorbent material is dried to a moisture content of less than about 25% of the weight of said superabsorbent material.

18. A method for forming a tissue product as defined in claim 1, wherein the tissue product contains multiple plies, one of which is formed by said paper web.

19. A method for forming a tissue product, said method comprising:

pre-swelling a superabsorbent material, said superabsorbent material having a total swelling capacity of from about 100 to about 350 grams of an aqueous solution per gram of said superabsorbent material;

forming a paper web from a cellulosic fibrous material and said pre-swollen superabsorbent material, wherein said superabsorbent material comprises from about 0.1% to about 5% by weight of said paper web; and at least partially drying said paper web;

wherein the tissue product is formed primarily from said paper web, the tissue product having a basis weight less than about 100 grams per square meter.

20. A method for forming a tissue product as defined in claim 19, wherein said tissue product is formed primarily from said paper web and one or more additional paper webs.

21. A method for forming a tissue product as defined in claim 19, wherein said superabsorbent material comprises from about 0.1% to about 3% by weight of said paper web.

22. A method for forming a tissue product as defined in claim 19, wherein said superabsorbent material is pre-swollen at least about 30% of its total swelling capacity.

23. A method for forming a tissue product as defined in claim 19, wherein said superabsorbent material is pre-swollen to at least about 50% of its total swelling capacity.

24. A method for forming a tissue product as defined in claim 19, wherein said superabsorbent material is pre-swollen to at least about 70% of its total swelling capacity.

* * * * *